US005478036A

United States Patent [19]

Wu

[11] Patent Number: 5,478,036

[45] Date of Patent: Dec. 26, 1995

[54] ASSEMBLY FOR CONNECTING TABLE TO A SCREEN PANEL

[76] Inventor: Ming-Hsin Wu, 20, Lane 92, Shing Ell Street, Tao Yuan City, Tao Yuan County, Taiwan

[21] Appl. No.: 240,623

[22] Filed: May 11, 1994

[51] Int. Cl.[6] ..... A47B 96/06

[52] U.S. Cl. ..... 248/220.22; 248/558; 248/224.7

[58] Field of Search ..... 248/220.2, 224.3, 248/235, 248, 300, 558; 108/153, 180; 52/36.4, 36.5, 239; 403/24, 300

[56] References Cited

U.S. PATENT DOCUMENTS 2,976,001 3/1961 Wulc ..... 248/220.2

5,070,666 12/1991 Looman ..... 52/239

5,094,053 3/1992 Militzer ..... 52/239

*Primary Examiner*—Leslie A. Braun

*Assistant Examiner*—Gwendolyn Wrenn

*Attorney, Agent, or Firm*—Bacon & Thomas

[57] ABSTRACT

A connecting device for a screen panel and a table includes a trim body which can be readily attached to the hollow portion of the edge of the screen panel. A connecting block is attached to the end portion of the trim body. A connecting bracket is attached to a connecting block. A plurality of screws can be applied to fasten the connecting bracket and the connecting block. The connecting bracket includes a pair of horizontal supporting plates to support a table thereon. A band cover is attached to the top of the trim body and the connecting bracket.

3 Claims, 4 Drawing Sheets

ASSEMBLY FOR CONNECTING TABLE TO A SCREEN PANEL

BACKGROUND OF THE INVENTION (A) Field of the Invention

This invention relates to a connecting and device, more particularly, to a connecting device for a plastic screen panel and a table. This connecting device facilitates an easy mounting of the table to any height of the screen panel. Accordingly, an integral and complete appearance is achieved and ensured.

(B) Description of the Prior Art

The plastic screen panel has been widely used in partitioning and decorating the office. This kind of screen panel can be assembled on site to form an individual working space for each staff member. This plastic screen panel is easy to wash and clean and, accordingly, it has become the main stream in decorating and positioning the office.

In the very beginning, the table is just enclosed by two screen panels located at three sides. No physical connection is provided between the table and the screen panel. Both the table and the screen panels are separated from each other. Accordingly, when the screen panel is bumped by something, the alignment between the screen panel and the table is lost. As a result, a space is formed between the screen panel and the table, for receiving debris. This results in an inconvenience to the office.

Hence, a connecting device is provided between the table and the screen panel to secure the alignment therebetween. By this provision, not only the connection between the table and the screen panels is enhanced, but also the legs of the table are replaced by the screen panels. The connecting mechanism, such as a steel or aluminum bracket, of this connecting device is attached to the side wall of the screen panels, then the table can be supported by the bracket. On the other hand, the connecting mechanism includes a supporting beam having attaching hooks at both sides and an associated positioning plate which has a plurality of lengthwise positioning holes. The supporting beam can attach with the screen panel by the engagement with the hooks and the positioning holes and, accordingly, the table is supported firmly by the supporting beam. In the connecting mechanism, the height of the supporting beam can be easily adjusted to meet different requirements. Even though this arrangement provides an enhanced connection between the screen panel and the table, a plurality of supporting beams and supporting positioning plates are required which increases the complexity and cost of the connecting mechanism. Above all, the positioning holes of the positioning plate are exposed and, the integrity of the screen panel is lost.

SUMMARY OF THE INVENTION

It is the object of this invention to provide a connecting device for a screen panel and a table wherein the screen panel is directly used to support the table.

In order to achieve this object, the connecting device includes a trim body which can be readily attached to the hollow portion of the edge of the screen panel. A connecting block is attached to the end portion of the trim body. A connecting bracket is attached to a connecting block. A plurality of screws can be applied to fasten the connecting bracket and the connecting block. The connecting bracket includes a pair of horizontal supporting plates to support a table thereon. A band cover is attached to the top of the trim body and the connecting bracket.

BRIEF DESCRIPTION OF THE DRAWINGS

The structural and operational characteristics of the present invention and its advantages as compared to the known state of the prior art will be better understood from the following description, in conjunction with the attached drawings which show illustratively but not restrictively an example of a connecting device for plastic a screen panel and a table. In the drawings.

DETAILED DESCRIPTION OF THE PREFERRED EMBODIMENT

Figure 1:
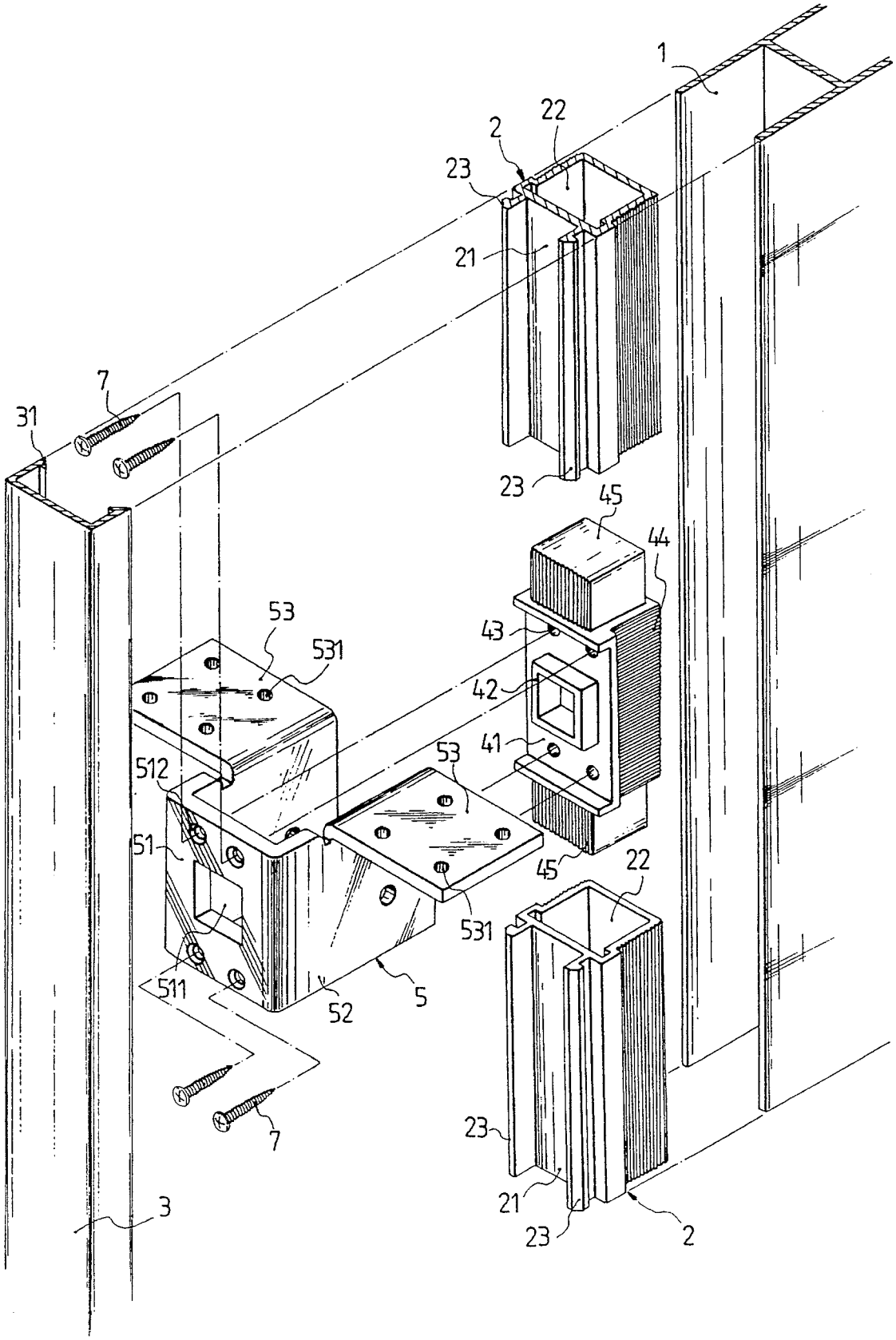
FIG. 1 is an exploded perspective view of the connecting device made according to this invention.

Referring to FIG. 1, a conventional screen panel 1 may incorporate with a connecting device of the invention to support a table 6. The connecting device made according to this invention includes a trim body 2, a U-shaped band cover 3, a connecting block 4 and a connecting bracket 5.

The trim body 2 has a generally rectangular front trim plate 21. A hollow projected portion 22 is provided at the rear of body 2. The projected portion 22 of the trim body 2 can be received and retained by the chamber of the plastic screen panel 1. The trim plate 21 is provided with two rearwardly extending hooking tabs 23 extending upward. By this arrangement, the hooks 31 of the band cover 3 can attach to the hooking tabs 23 of said trim plate 21 to enclose the edge of the screen panel 1.

The connecting block 4 is formed by a metal plate 41 which has the same width as the trim plate 21 of the trim body 2. The metal plate 41 further includes a positioning block 42 at the front. The metal plate 41 is provided with a plurality of holes 43 adjacent to the positioning block 42. The connecting block 4 further includes a pair of rearwardly extending retaining plates 44 which can be received and retained within the chamber of the plastic screen panel 1. The retaining plates 44 can also be received by the projected portion 22 of the trim body 2. A connecting bar 45 is provided at both the top and bottom of the metal plate 41. The connecting bars 45 can each be received and retained by the projected portion 22 of a trim body 2.

Figure 2:
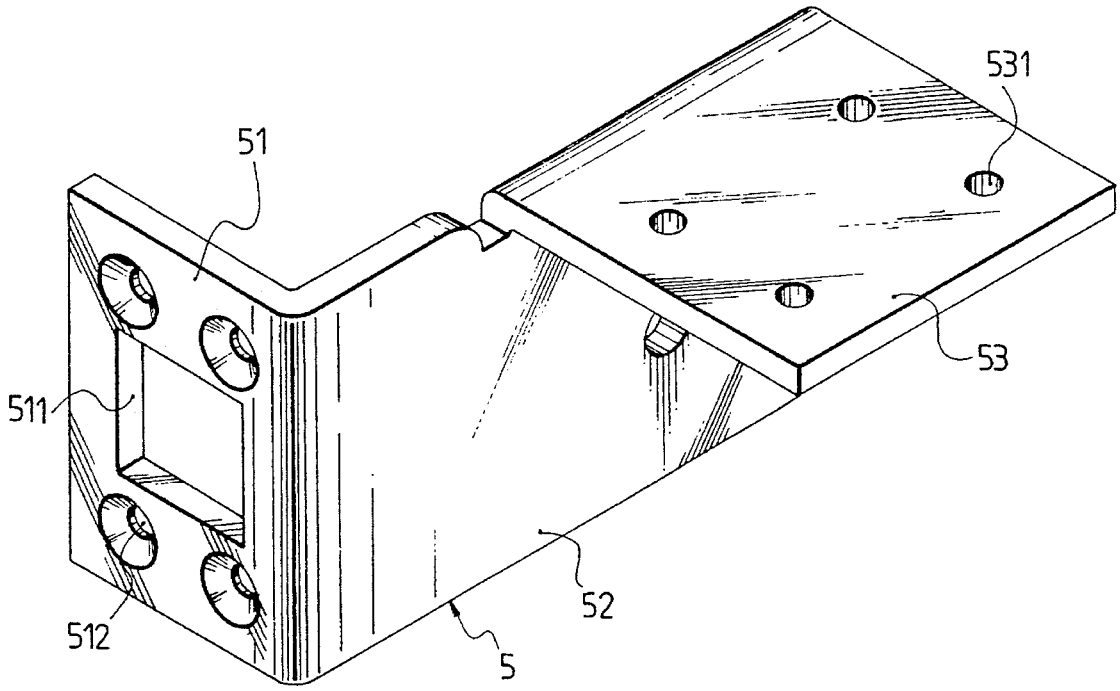
FIG. 2 is a perspective view of a connecting bracket made according to this invention.
Figure 3:
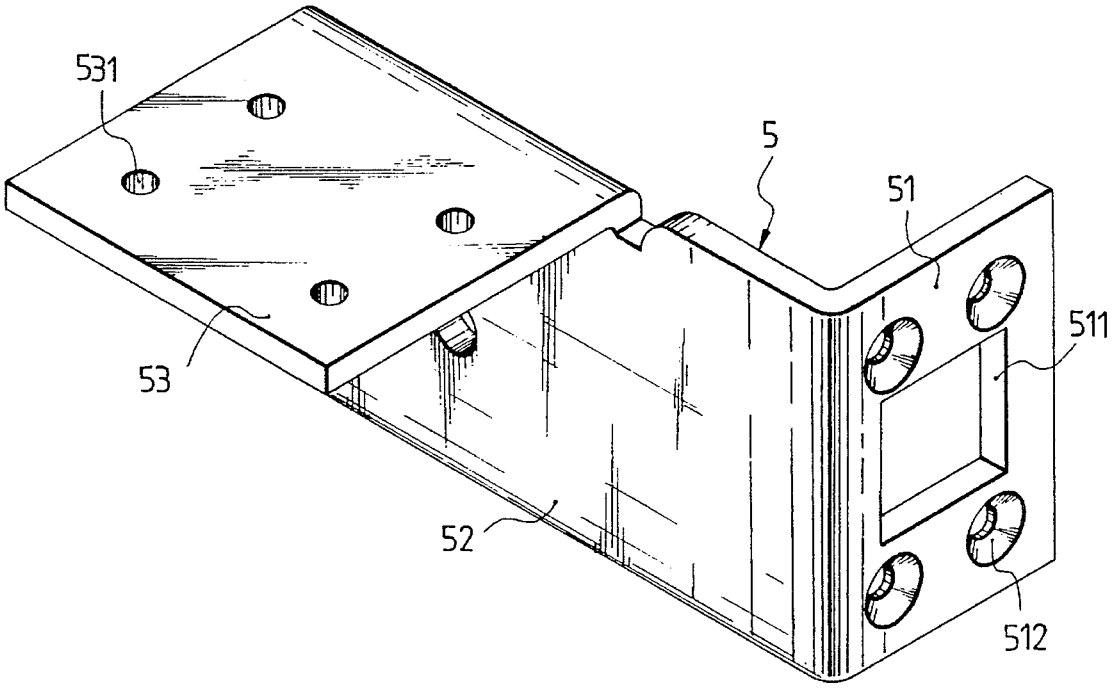
FIG. 3 is still another perspective view of a connecting bracket made according to this invention.
Figure 4:
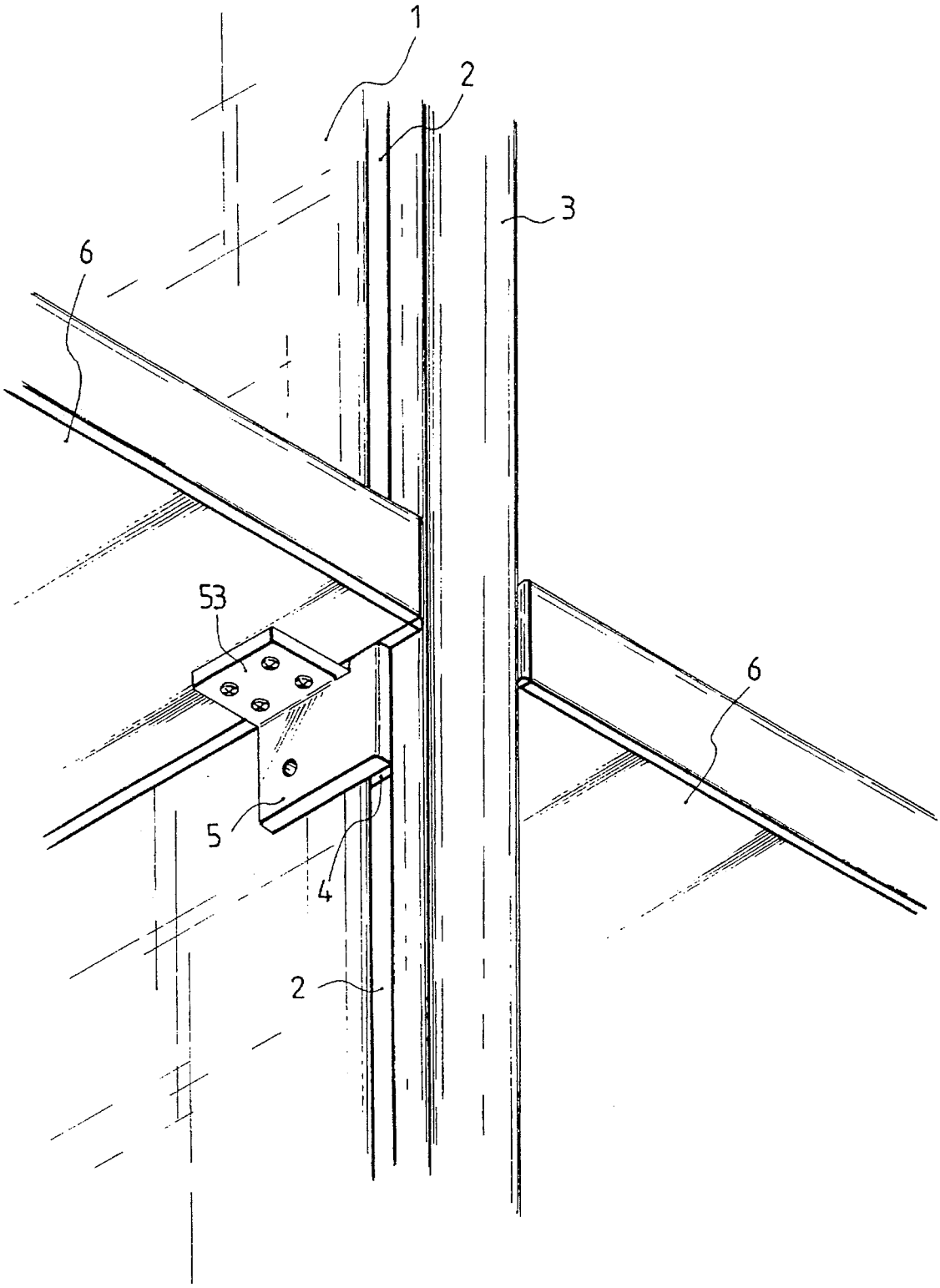
FIG. 4 is a perspective view showing the table being supported by the connecting bracket attached to the screen panel.

A connecting bracket 5 is made from a rigid material. As shown in FIGS. 2 and 3, this connecting bracket 5 generally includes a saddle plate 51 having a front rectangular opening 511 which can envelop onto the positioning block 42 of the connecting block 4. The connecting bracket 5 further includes a plurality of holes around the rectangular opening 51 in alignment with the holes 43 of the connecting block 4. A pair of side plates 52 extended rearwardly from both ends of the saddle plate 51 to a desired length. Each side plate 52 is provided with a horizontal supporting plate 53 which is orthogonal to the side plate 52. Each supporting plate 53 is provided with a plurality of positioning holes 531.

In assembling, the trim body 2 of suitable length is firstly inserted into the edge of the screen panel 1. Then the connecting bars 45 of the connecting block 4 are attached to projected portions 22 of two adjacent trim bodies 2. Thus the connecting block 4 is fixed to the screen panel 1 firmly and completely. Then the connecting bracket 5 is attached onto the connecting block 4 in such a manner that the rectangular opening 511 of the saddle plate 51 is enveloped onto the projected block 42 of the metal plate 41 of the connecting block 4. Then a plurality of screw 7 are used to secure the connecting bracket 5 to the connecting block 4. When this procedure is completed, a band cover 3 is attached to the trim body 2 to provide a complete exterior finish.

When the connecting bracket 5 is attached to the connecting block 4, each of the horizontal supporting plates 53 is located at side of the screen panel 1, and accordingly, the table 6 can be secured thereon by means of screws 7. The structure and effort of this assembly are very simple and the customer can complete this easily and quickly.

Figure 5:
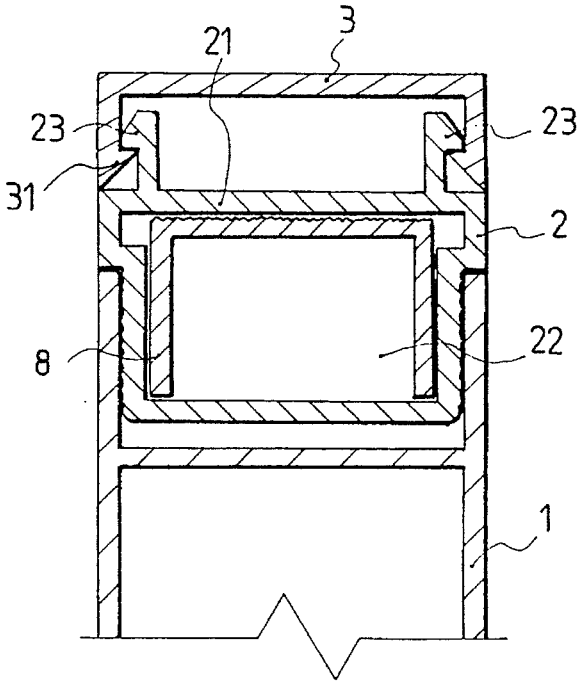
FIG. 5 is a cross sectional view of the screen panel without a connecting device.
Figure 6:
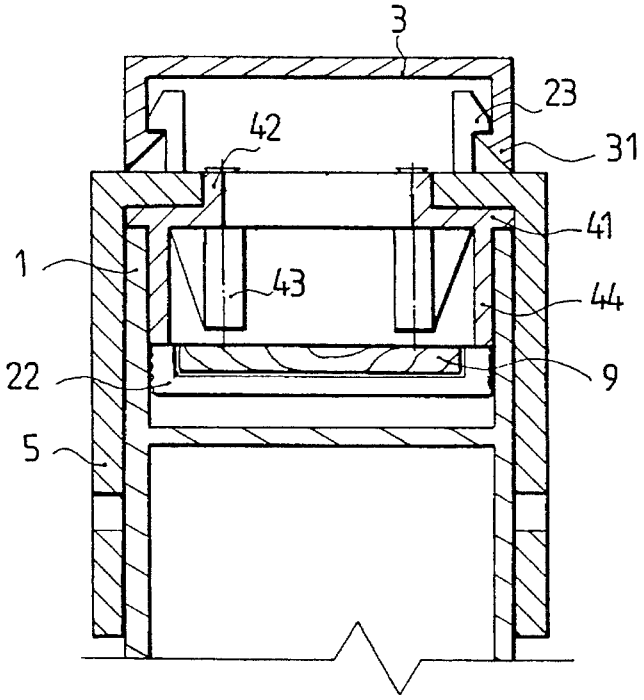
FIG. 6 is a cross section view of the screen panel wherein a connecting device is disposed thereon.

Furthermore, a wooden block 8 or steel beam 9 can be disposed within the projected portion 22 of the trim body 2. Accordingly, the strength of the screen panel is enhanced, as shown in FIGS. 5 and 6. By this arrangement, the alignment between the screen panel 1 and the table 6 will never fail.

Although the present invention has been described in connection with the preferred embodiments thereof, many other variations and modifications will now become apparent to those skilled in the art without departing from the scope of the invention. It is preferred, therefore, that the present invention not be limited by the specific disclosure herein, but only by the appended claims.

I claim:

1. An assembly for connecting a table to a screen panel of the type having a hollow edge portion, the assembly comprising:

a) at least one trim body including a front trim plate, a rearwardly extending hollow projected portion for engaging the hollow edge portion of the screen panel, and a pair of forwardly extending hooking tabs;

b) a connecting block including a front plate provided with a plurality of fastener holes and a forwardly extending positioning block, a pair of retaining plates extending rearwardly of the front plate for engagement within the hollow edge portion of the screen panel, and at least one connecting bar for engaging the projected portion of the trim body;

c) a connecting bracket including a front plate provided with an opening for receiving the positioning block and disposing the holes of the front plate in alignment with the holes of the front plate of the connecting block, at least one side plate extending rearwardly of the front plate, and a horizontal supporting plate for supporting a table surface extending orthogonally from the side plate; and d) a band cover having a substantially U-shaped configuration and including a pair of rearwardly directed hooks for locking engagement with the hooking tabs of the trim body.

2. The assembly of claim 1 further including a pair of trim bodies and the connecting block including a top connecting bar and a bottom connecting bar for engaging the projected portions of the pair of trim bodies.

3. The assembly of claim 1 wherein the connecting bracket includes a pair of side plates extending rearwardly from the front plate, with each side plate including a horizontal supporting plate extending orthogonally therefrom, each supporting plate including a plurality of holes for securing a table to the supporting plate by means of fasteners.

* * * * *